United States Patent [19]

Whiteford

[11] Patent Number: 4,907,810

[45] Date of Patent: Mar. 13, 1990

[54] RACQUET HANDLE

[76] Inventor: Carlton L. Whiteford, 3 High Point Rd., Westport, Conn. 06880

[21] Appl. No.: 251,981

[22] Filed: Sep. 27, 1988

Related U.S. Application Data

[63] Continuation of Ser. No. 842,288, Mar. 21, 1986, abandoned.

[51] Int. Cl.[4] ..... A63B 49/08

[52] U.S. Cl. ..... 273/73 J; 273/75; 273/81 R

[58] Field of Search ..... 273/73 J, 75, 73 R, 273/73 K, 67 R, 67 DA, 72 R, 72 A, 81 R, 162; 81/489, 22, 177.7, 177.75; 16/110 R, 114 R; 74/551.8, 551.9, 551.2; 272/122, 123, 124

[56] References Cited

U.S. PATENT DOCUMENTS

| | | | |
|---|---|---|---|
| 4,108,436 | 8/1978 | Masi | 273/75 |
| 4,537,399 | 8/1985 | Adam | 273/73 J |
| 4,660,832 | 4/1987 | Shomo | 273/73 J |
| 4,691,926 | 9/1987 | Adam | 273/73 I |

FOREIGN PATENT DOCUMENTS

| | | | |
|---|---|---|---|
| 3413600 | 8/1985 | Fed. Rep. of Germany | 273/73 J |
| 3428528 | 2/1986 | Fed. Rep. of Germany | 273/73 J |
| 422518 | 12/1946 | Italy | 74/551.9 |
| 14025 | of 1891 | United Kingdom | 74/551.9 |
| 22303 | of 1898 | United Kingdom | 273/81 R |
| 2149311 | 6/1985 | United Kingdom | 273/73 J |

*Primary Examiner*—Edward M. Coven
*Assistant Examiner*—Jessica Harrison
*Attorney, Agent, or Firm*—Fulwider, Patton, Lee & Utecht

[57] ABSTRACT

A ventilated and shock absorbing racquet handle construction for maintaining a cooler, drier grip and therefore, better control during play, the handle comprising a rigid tubular member having a plurality of apertures and plural longitudinal ribs, coaxially mounted on the handle shank through interposed plural strips of shock absorbing material and defining an interior annular passageway for air circulation. A leather wrapping member having another plurality of apertures is helically wound about the tubular member, and random registration of both sets of apertures communicates air currents between the annular passageway, the tubular member, and the leather wrapping member. Another embodiment provides for the pivotal mounting of the tubular member using a strike pin extending radially through the shank.

14 Claims, 2 Drawing Sheets

RACQUET HANDLE

This application is a continuation of application Ser. No. 842,288, filed Mar. 21, 1986, now abandoned.

BACKGROUND OF THE INVENTION

This invention relates generally to grips and, more particularly, to a new and improved racquet handle which is both ventilating and shock absorbing for keeping a player's hand cool, dry and in better control of his or her play. In many of the active racquet sports, such as tennis, squash, and racquet ball, substantial physical exertion is required of a player during the course of play. Typically, this results in rather profuse perspiration, especially by the racquet-holding hand. Throughout the years, this has made it difficult for a player to maintain an effective grip upon the racquet, since the grip surface becomes wet and slippery. This can significantly degrade the level of play, particularly if the racquet rotates in the player's hand, changing the angle of the racquet face. Furthermore, the risk of injury is increased since the racquet is more likely to slip out of the player's hand. In some racquet sports, such as racquetball, it is common to provide an over-the-wrist retaining strap to avoid the accidental release of the racquet during active play.

In the past, various handle designs for racquets and other items have been provided with ventilation features. One such construction includes an exterior covering cooperating with an enlongated shaft to define an internal cavity. This internal cavity is in fluid communication with the exterior portion of the grip to aerate the hand surface. However, this structure provided no structural support and tended to rotate about the shaft.

Tennis racquet ventilation assemblies generally include a central longitudinal bore, within the handle shank, in fluid communication with plural radial cross-bores or passages. A variety of groove patterns in fluid communication with the plural cross-bores are machined into the external handle surface. Apertures in a leather gripping surface are completely registered to maximize air flow over the surface of the player's hand. However, such arrangements have suffered from a number of deficiencies including decreased structural integrity resulting from the longitudinal bore and the plural cross-bores; the intricate, time-consuming, and costly machining processes required to provide cross-bores, surface groove patterns or completely registered apertures; and a questionable ventilation effectiveness because of the substantial distance between the longitudinal bore and the grip surface. Hence, such efforts have not been well received by those skilled in the art.

In addition, modern racquet handles generally include a substantially solid sub-handle portion disposed between the racquet shank and the leather wrapping member. The solid sub-handle, usually constructed of polyurethane foam or other elastomeric material, is required to absorb the impact forces created when the racquet strikes the playing ball and to prevent their transmission to the player's hand and elbow. Because of this solid construction, conventional handle assemblies totally inhibit the flow of air. Furthermore, because of the lack of structural integrity of the shock absorbing sub-handle, the entire length of the shank must be encased in this material, thereby increasing the weight of the racquet.

Hence, there has been a significant, long existing need for a racquet handle which provides a mechanism to cool and dry both its gripping surface and the player's hand. Alternatively, there exists a significant need for a racquet handle having an exceptional degree of ventilating effectiveness which does not in any way compromise the structural integrity, shock absorption qualities, nor the racquet control during play. The present invention clearly fulfills all of these needs and provides further related advantages.

SUMMARY OF THE INVENTION

In accordance with the present invention, a ventilated and shock absorbing racquet handle assembly is provided which has an exceptional degree of ventilating effectiveness and which, at the same time, does not in any way compromise either the structural aspects of the racquet handle nor the control of racquet during play. Briefly, and in general terms, a racquet handle constructed in accordance with the present invention may include: a shank portion of the handle; a tubular member, having a plurality of apertures therein, coaxially mounted on the shank portion, the shank portion and tubular member cooperating to define an annular passageway; and a wrapping member to diffuse and evaporate moisture or perspiration from the gripping hand or glove, the wrapping member having a plurality of apertures therein which randomly register with those in the tubular member.

More specifically, in one preferred form, the racquet handle of the present invention is comprised of a rigid tubular shell member, formed of a mesh or screen material having apertures constituting at least 40% of its surface area. The shell member is shaped to duplicate the cross-sectional configuration of a conventional racquet handle. Plural longitudinal ribs extend radially inward from the shell member towards the handle shank. Plural shock absorbing elastomeric strips, mounted on the shank, are supported between the shank and the shell member and in contact with both of these elements. An epoxy or similar curable resin material binds the strips to the shank and the tubular member. This coaxial mounting configuration provides the desired structural integrity, and shock absorption characteristics, and enables the shell member and the shank to define a longitudinal annular passageway in close proximity to an overwrap element, typically leather, for communicating air currents to the absorbing and evaporating overwrap element.

The present invention further includes an external overwrap member, commonly in the form of a continuous strip of perforated material, commonly leather. This overwrap distributes the moisture and perspiration from the player's hand and/or the glove over a greater surface area to facilitate evaporation. A plurality of apertures are formed in the overwrap, these plural apertures randomly registering with those formed in the tubular member.

For a more complete understanding of the above and other features and advantages of the invention, reference should be made to the following more detailed description of a presently preferred embodiment of the invention and to the accompanying drawings.

DETAILED DESCRIPTION OF THE DRAWINGS

Figure 1:
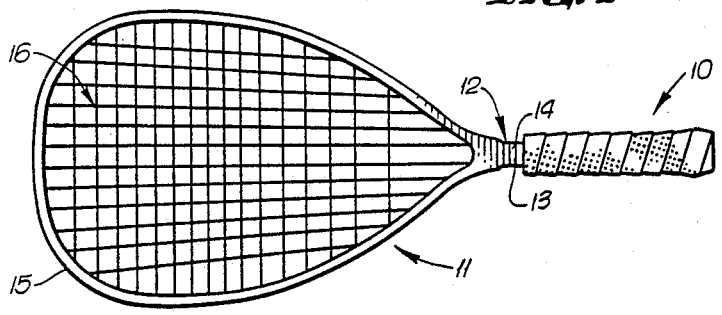
FIG. 1 is a plan view of a racquet constructed in accordance with the present invention.
Figure 2:
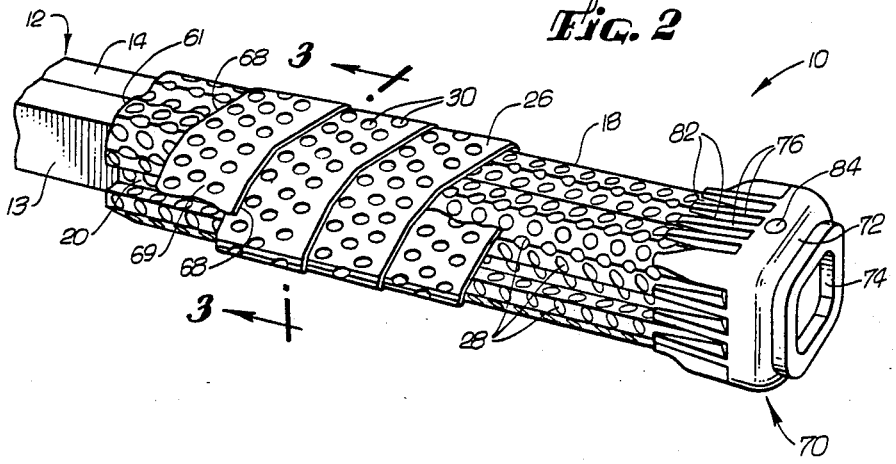
FIG. 2 is a fragmentary, perspective view of a racquet handle and assembled racquet stem, in accordance with the invention.
Figure 3:
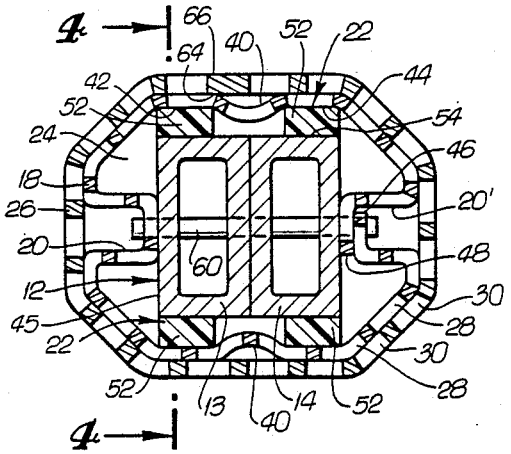
FIG. 3 is an enlarged, cross-sectional view, taken substantially along the line 3—3 in FIG. 2.

As shown in the exemplary drawings for the purpose of illustration, a ventilated and shock absorbing handle assembly, referred to generally by the reference numeral 10 in FIG. 1, is provided for keeping the player's hand and/or glove and gripping surface cooler and drier without sacrificing structural integrity nor user's control. As shown in FIG. 1-3, a racquet 11 includes an elongated handle or shank 12 comprised of two parallel and juxtaposed shank sections 13 and 14, which at an appropriate distance from the handle structure 10, separate to form the oval racquet head 15 with a planar racquet face 16. The shank 12 is then inserted into a handle assembly 10. The handle assembly of the present invention includes the shank 12, a tubular member 18, having plural longitudinal ribs 20, mounted on the shank 12 by shock absorbing means 22, the tubular member cooperating with the shank to define an annular passageway 24. An overwrap member 26 is disposed about the tubular member 18. A first plurality of apertures 28 in the tubular member 18 randomly register with a second plurality of apertures 30 in the overwrap member 26 to provide a fluid communication path between the annular passageway 24, the overwrap member 26 and a player's hand and/or glove (not shown).

The improved handle assembly 10 of the present invention provides a relatively inexpensive yet highly convenient and easy-to-use apparatus for enabling the perspiring player to maintain an effective grip the normally wet and slippery handle. This relatively easy-to-manufacture handle assembly 10 concurrently dries the hand by absorbing perspiration and cools the hand by an increased evaporative ability. The annular passageway 24 and the plural apertures 28 within the tubular member 18 increase the air flow communicating with the overwrap 26. The overwrap 26, distributing the moisture, as by capillary action in the case of leather, through the overwrap, increases the surface area subject to evaporative cooling. Thus, by increasing the air flow impinging upon an increased surface area, the present invention facilitates the cooling and drying of the operator's hand and/or glove. Furthermore, the decreased registration or mating of the apertures in the tubular member 18 with those in the leather overwrap 26 facilitate rather than inhibit this cooling and drying effect. As a result, the racquet's handle and the player's hand and/or glove are cooled by a structure that is easier and less expensive to manufacture. Furthermore, the present invention's construction presents an external appearance and feel similar to conventionally constructed racquets, avoiding the reluctance of the purchasing public to deviate from conventional racquet configurations.

More specifically, the handle assembly 10 of the present invention includes a sub-handle rigid tubular or skeletal member 18. The tubular skeletal member 18 is preferably formed of a material typically between 10 and 100 mils thick (1 mil = 0.25 m), to provide structural integrity. The appropriate thickness is selected depending upon the strength or tensile modulus of the specific material used. At least for some applications, ordinary cold rolled steel is adequate, although stainless steel may be preferred for higher quality construction and rust resistance. Other materials such as magnesium, titanium, aluminium, plastic and carbon fiber compounds may also be used to construct the tubular member 18.

In a presently preferred embodiment, and as best observed in FIG. 3 of the drawings, the tubular member 18 comprises an octagonal, cross-sectionally shaped cylinder. While this configuration is not a critical feature of the invention, it duplicates the shape of conventional racquet handles. As such, the preferable configuration is octogonal for tennis and racquetball racquet handles and ovoid for squash racquet handles.

Furthermore, formed in the rigid tubular member 18 are a first plurality of apertures 28, preferably uniformly dispersed over substantially the entire surface of the tubular member. The apertures 28, in aggregation, constitute at least 40% and preferably about 55 to 70% of the effective surface area of the tubular member 18. In this connection, the term "effective surface area" refers to the total surface area of the tubular member prior to the provision of apertures therein. Conveniently, the apertures 28 may be circular in form, approximately five-thirty-seconds (5/32) of an inch in diameter. Other aperture shapes and sizes may also be used so long as the aggregate surface satisfies the above constraints.

Extending radially inward from the tubular member 18 towards the shank 12, is a plurality of longitudinal U-shaped ribs 20. In one preferred embodiment, two opposed ribs 20 extend the entire internal longitudinal length of the tubular member 18 towards the shank 12 on an axis parallel to the planar racquet face 16. These ribs 20 extend closely towards the external surface of the racquet shank 12.

Additionally, substantially perpendicular or orthogonal to the longitudinal ribs 20 are the radially, inwardly extending ridges 40. These medially formed ridges in the tubular member 18 extend radially inward but do not engage the shank 12. Indeed, the ridges 40 and the tubular member 18 define a plurality of longitudinal parallel grooves 42 and 44. The shock absorbing means 22 are disposed within these grooves 42 and 44 as later described. Preferably, in the shaping of the tubular member 18, the material is formed to integrally include the two longitudinally extending ribs 20 and the plural medially formed ridges 40. Preferably the pair of grooves 42 and 44 is disposed in the tubular member 18 relative to the shank 12 on shank surfaces 45 substantially orthogonal to the ribs 20 and parallel to the racquet face 15. As best illustrated in FIG. 3, one of the longitudinally extending ribs, identified as 20', may include opposite edges 46 and 48 of the section used to form the tubular member 18. These edge sections 46 and 48 may be overlapped or abutted, and secured by spot welding, epoxy bonding or other means.

Interposed and tightly engaged between the shank 12 and the tubular member 18 are plural shock absorbing members 52. In one form, these shock absorbing members 52 are three-sixteenths (3/16) inches wide and one-eighth (⅛) inch thick strips of elastomeric or other vibration isolating materials. In the preferred form, pairs of elastomeric members 52 are mounted on opposite sides of the shank 12 within the grooves 42 and 44. As shown more clearly in FIG. 4, in one embodiment the plural elastomeric strips 52 extend the length of the engaging surface between the shank 12 and the tubular member 18, while as depicted in FIG. 5, plural elastic members 52 may be shortened in length and disposed on a portion distal from the racquet head 15 adjacent the end portion of the shank 12.

In order to mount the tubular member 18 securely to the racquet shank 12, appropriate surface areas of the racquet shank 12 and/or the shock absorbing means 22 may be pre-coated with an epoxy or similar curable resin material, as generally indicated at 54 in FIG. 3. The shank 12 is then received longitudinally into the interior of the tubular member 18, and the bonding material 54 thereafter is allowed to set and cure. Hence the tubular member 18 is mounted on the shank 12 by bonding the tubular member to the shock absorbing means 22 and bonding the shock absorbing means to the shank. By using high strength epoxy materials, compatible with the epoxy components of the composite structural materials of the shank 12, extremely strong-bonded mounting of the handle to the shank may be accomplished. Preferably a security pin 60 is radially inserted through the shank 12 and tubular member 18 as a precaution to prevent the handle assembly 10 from unintentionally detaching from the shank 12.

In more detail, the coaxial mounting of the tubular member 18 and the shank 12 cooperate to define the longitudinal annular passageway 24 having annular openings 61 and 62 at opposite ends to communicate air currents therethrough to the evaporating overwrap element 26. More specifically, in describing the internal cross-sectional configuration, the shank 12 occupies no more than 80% of the internal cross-sectional area of the tubular member 18. Alternatively the annular passageway 24 occupies at least 20% of the internal cross-sectional area of the tubular member 18.

Figure 4:
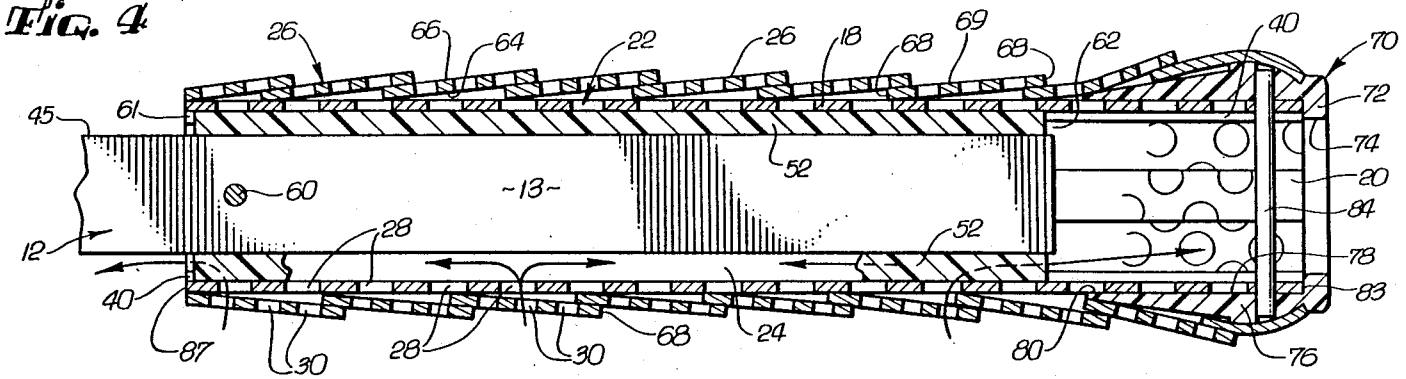
FIG. 4 is a longitudinal, sectional view taken substantially along the line 4—4 in FIG. 3.
Figure 5:
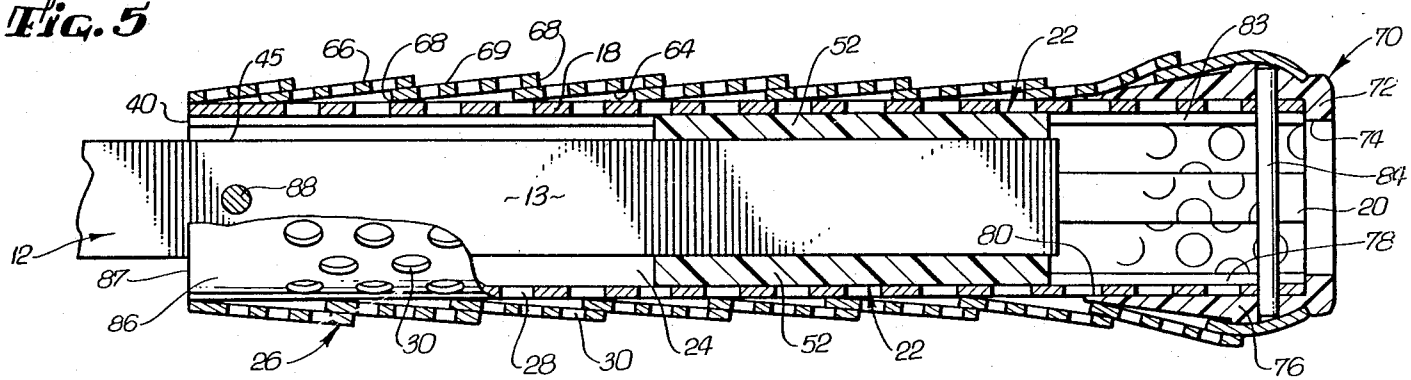
FIG. 5 is a longitudinal, sectional view, similar to FIG. 4, but illustrating an alternative embodiment of the invention of another preferred embodiment.

As reflected more particularly in FIGS. 3–5, the perforated tubular member 18, is provided with an external overwrap member 26, having an interior surface 64 and an exterior surface 66. In one form, the overwrap member 26 includes a continuous leather strip, a material familiar to and desired by a large percentage of the racquet sports players. While leather has the added characteristic of absorbing moisture, the primary function is evaporation which may be accomplished by non-absorbing materials such as vinyl and polyurethane, by way of example and not by way of limitation. This overwrap member 26, functions to remove or control moisture by evaporation by distributing or diffusing this moisture throughout a greater surface area. This moisture dispersal increases the effect of the applied ventilation and thus maximizes the evaporative or conductive cooling of the gripping element and the player's hand.

In one embodiment of the invention, the use of a multi-layer overwrap is contemplated, wherein different layers of hydrophilic and/or hydrophobic materials are used to manipulate or channel the absorption and capillary functions of this overwrap element 26. This would enable a selection of an overwrap 26 to satisfy various perspiration or moisture evaporation requirements. In this respect hydrophilic materials may be formed in a layer in direct contact with the players hand, in order to absorb perspiration from the surface of the skin.

Commonly, the overwrap member 26 is formed of leather strips approximately three-fourths (¾) of an inch wide and 0.050 of an inch thick. Along each edge 68 of the overwrap member, the strips maybe tapered, and then helically disposed about the tubular member 18 so that the tapered edge portions of adjacent convolutions overlap. The resulting continuous overwrapped surface is of relatively uniform thickness. Of course, it should be understood that the invention does not require that the overwrapping be of a familiar edge-overlapped spiral construction.

In accordance with one aspect of the invention, the overwrapping member 26 is provided with a second plurality of apertures 30, uniformly distributed over its exterior surface, at least in the central portion 69 between the tapered edges 68. These plural apertures 30 typically are of a uniform size and shape, the apertures 30 being circular and of about one-eighth (⅛) inch in diameter or less.

In accordance with the invention, when the overwrapping member 26 is engaged with the tubular member 18, the random registration of apertures 28 (member 18) with apertures 30 (member 26) combine to provide an aggregate open surface area substantially between the annular passageway 24 and exterior of the racquet handle relative to the total outer surface area of the wrapped portion of the handle 10. This can be provided by a tubular member 18 having at least 30% and preferably in the range of approximately 55–80% aggregate open area and the overwrapping member 26 to have an approximate minimum of 20% open, and preferably in the range of approximately 25–35% aggregate open area. The factor of principal significance, according to the invention, is the random registration of the holes which provides a mixture of registered and non-registered apertures.

In the present invention, this mixture of apertures is by random registration and partial registrations of the plural openings 28 and 30, and is achieved by the helical wrapping of the overwrap member 26 about the tubular member 18 thereby allowing some portions of the underside of the overwrap to be exposed to the air movement through the annular passageway.

In addition, the handle assembly 10 of the present invention includes a butt cap or end wrap 70. As best observed in FIGS. 2, 4 and 5 of the drawings, the end wrap 70 includes a bottom wall 72 having a first opening 74, with plural sidewalls 76 extending upward to define an interior cavity 78 communicating with a second opening 80. In one preferred form, the plural sidewalls 76 are formed with plural slotted openings 82 of a width substantially equal to that of the plural apertures 28 disposed in the tubular members 18. The distal or butt end 83 of the tubular member 18 is preferably received into the cavity 78 a sufficient distance to abutt the bottom wall 72. An end wrap pin 84 is inserted radially through the tubular member 18 and the end wrap member 70 so as to retain the end wrap 70 in a coaxial mount upon the tubular member 18.

If desired, the end wrap 70 may itself be of an open apertured construction, consistent with the remainder of the handle. However, it is considered to be within the teachings of the invention if the end wrap 70, typically having an overall length of less than one inch, may be of an imperforate construction The function and purpose of the end wrap is to reduce the likelihood of the racquet slipping out of the player's hand during play and to assist in maintaining the overwrap member 26 disposed about the tubular member 18.

In a second embodiment more specifically depicted in FIG. 5, an unperforated or reinforced portion 86 of the tubular member 26 is formed. This portion 86 is disposed at the end 87 opposite distal portion 83 of tubular member 18, (adjacent the oval racquet head structure 15). A strike or striking pin 88, replaces retaining pin 60 and is radially inserted through the portion 86 to pivotally connect the tubular member 18 upon the racquet shank 12 adjacent the racquet head 15. In this embodiment, the shock absorbing members 22 need not extend the full length of the shank but may need only have an elastomeric member 52 of a length sufficient to cover a 2–3 apertures 30.

In operation, the handle assembly 10 of the present invention is grasped by the user in the normal manner befitting a conventional tennis racquet or the like. Moisture or perspiration beading upon the surface of the user's hand is distributed by the engaged overwrap surface 26. If leather is used, the absorbed moisture is distributed by capillary action and channelled by the appropriate hydrophilic layers to the interior surface 64 of the overwrap 26. Air flows as indicated by the arrow in FIG. 4 within the annular passageway 24 and through the apertures 28 and 30, to cool the interfaced overwrap member 26 and the player's hand by conductive, convective and evaporative principles.

Indeed, it is the mixture of registered and non-registered apertures or holes which increases the cooling and drying capacity of the racquet handle. In terms of evaporative cooling, tubular member apertures 28 which are not registered with overwrap member apertures 30, but communicate with the interior surface 64 of the overwrap member 26 enable the surface 64 to provide an additional surface area from which evaporation can occur. Thus, instead of only an exterior surface 66 partially covered by the gripping hand, a portion of this interior surface 64 is exposed to circulating air. Evaporative cooling of this exposed interior surface 64, not present in conventional racquets, cools and dries both the overwrap and the player's hand.

In addition overwrap member apertures 30 which are not registered with tubular member apertures 28, but communicate with the surface of the tubular member 18, may facilitate the conductive transfer of heat to the tubular member 18. This may enable the tubular member, if it is of metal construction, to aid in the conductive transfer of heat. Indeed, this warmed tubular member 18 will further increase the evaporative cooling effect of the overall handle assembly 10. Indeed, non-registered apertures 30 may also provide a plurality of pockets or cavities within the overwrap member 26 to provide a structure which retains the perspiration off the exterior surface 66. This aids in preventing the build-up of moisture between the hand and the grip surface and further reduces slippage. In this sense, the apertures would be functioning as reservoirs to store moisture off the gripping surface until it can be distributed by the hydrophylic layers of the overwrap member 26, or to be evaporated directly by the air currents in the annular passageway.

A less than complete registration concurrently enables the direct circulation of air upon the surface of the hand, providing a cooling conductive transfer of heat to the circulating air and faciliating direct evaporation off the gripping hand and/or glove. Thus, contrary to any teachings of the prior art, the inventor has recognized that a mixture of non-registered and registered holes increases the cooling and drying of the handle and the player's hand. This increased ventilation can be achieved without providing longitudinal bores or lateral connecting cross-bores in the shank weakening the structural integrity of the racquet. Furthermore, the shock-absorbent qualities are not diminished by merely using strips 52 as opposed to a solid elastic sub-handle assembly conventionally employed.

In addition, the incorporation of the elastomeric shock absorbing means 22 enables the use of a rigid tubular member to provide the structural integrity necessary to allow a racquet construction without the racquet shank extending the full width of the handle. Indeed, early prototypes disclosed that merely mounting a metal tubular member upon the racquet shank, while enabling the evaporative abilities as earlier described, were prohibitively transmitting the impact force of the racquet striking the ball to the player's hand, arm and elbow. Indeed the shank 12, in conjunction with elastomeric members 52 and rigid tubular member 18, need only be engaged with a portion, e.g. about 50% of the handle's interior length, decreasing the weight of the racquet and increasing its ventilating ability.

In an alternative embodiment impact upon the racquet face 16 will cause the distal portion of the handle shank 12 to pivot about the strike pin 88 to move relative to the handle 10 and compress the interposed shock absorbing means 22 which includes plural elastomeric members 52. The impact shock is then dissipated by the shock absorbing means 22. As will be recognized in this embodiment, the longitudinal ribs 20 are not fixedly mounted to the shank 12, but may contact the shank lightly while concurrently enabling the shank to move or flex relative the tubular member 18. Where the tubular member 18 is pivoting upon a strike pin 88, only a minimal amount of the shock absorbing means is needed to merely prevent the outside member from striking the surface of the shank 12. By this construction, the present invention also enables the handle assemblies to be assembled at the retail establishment by shop personnel. This enables a retail store to assemble the handles 10 to shanks 12 reducing the inventory of assembled racquets needed.

Finally, the creation of annular passageway 24 having at least 20% of the internal cross-sectional area of the tubular member 18, assures that there is a substantial flow area inside the tubular member 18 immediately adjacent the apertures or mesh openings 28 to enable the relatively unimpeded exchange of air within the interior of the handle assembly Indeed, because of the present invention's construction, the annular passageway 24 is separated from the overwrap member 26 only by the thickness of the tubular member 18. This increases the cooling and evaporative effect of the present invention. Furthermore, because of the inherent strength of the rigid tubular member 18, the entire length of shank 12 need not be engaged with the handle 10. This lightens the racquet and promotes ventilation without sacrificing the racquet's structural integrity.

A variety of further modifications and improvements to the invention described herein are believed to be apparent to those skilled in the art. Accordingly, no limitation on the invention is intended by way of the description herein, except as set forth in the appended claims.

What is claimed is:

1. A racquet handle assembly for grasping by a player's hand, comprising:

a shank;

a tubular member, said shank and said tubular member cooperating to define an annular passageway, said tubular member having a first plurality of apertures therethrough, means for pivotally mounting said tubular member upon said shank;

shock absorbing strips tightly engaged between said shank and said tubular member; and moisture removal means mounted on said tubular member, said moisture removal means having a second plurality of apertures therethrough, said first and said second plurality of apertures cooperating to communicate said annular passageway and said moisture removal means and to provide a mixture of registered and unregistered apertures, such that air may flow through said annular cavity to impinge upon said moisture removal means and said player's hand to increase the evaporation of perspiration therefrom.

2. A handle assembly as set forth in claim 1, wherein said tubular member includes a reinforced portion, and wherein said means for pivotally mounting includes a strike pin extending radially through said shank and connected to said reinforced portion of said tubular member.

3. A handle assembly as set forth in claim 2, and further including a plurality of longitudinal ribs projecting radially inward from said tubular member towards said shank, said ribs lightly contacting said shank, enabling said shank to move relative to said tubular member.

4. A racquet handle assembly extending from a racquet head having a racquet face, said racquet handle assembly comprising:

a shank extending from a racquet head;

a tubular member positioned about said shank and cooperating with said shank to define a cavity therebetween;

first means for restraining relative movement of said tubular member relative to said shank generally in a plane defined by a racquet face;

second means for permitting limited relative movement of said tubular member relative to said shank in a plane substantially orthogonal to a plane defined by a racquet face; and shock absorbing means positioned on opposing sides of said shank and between said shank and said tubular member generally in a plane defined by a racquet face and being said second means for yieldably resisting such limited relative movement therebetween, said shock absorbing means including a plurality of elongated generally parallel elastomeric vibration isolating strips, said first means for restraining relative movement of said tubular member relative to said shank generally in a plane defined by a racquet face being an adhesive bond between each of said elastomeric strips and said shank and between each of said elastomeric strips and said tubular member.

5. A racquet handle as set forth in claim 4, wherein said first means includes longitudinal ribs on said tubular member extending inwardly towards said shank.

6. A racquet handle as set forth in claim 4, wherein said tubular member includes a pair of longitudinal ridges formed therein, said ridges being located on opposite sides of said shank and extending inwardly toward said shank.

7. A racquet handle as set forth in claim 6, wherein said elastomeric strips are positioned adjacent said ridges.

8. A racquet handle assembly extending from a racquet head having a racquet face, said racquet handle assembly comprising:

a shank extending from the racquet head;

a tubular rigid one piece member positioned about said shank for limited relative movement in a plane substantially orthogonal to a plane defined by a racquet face and cooperating with said shank to define an annular cavity therebetween, said tubular member having a plurality of apertures extending through said tubular member to communicate said cavity and the atmosphere;

shock absorbing means, positioned on opposing sides of said shank and between said shank and said tubular member, generally in a plane defined by a racquet face, for yieldably allowing limited relative movement therebetween in a plane substantially orthogonal to a plane defined by a racquet face, said shock absorbing means including a plurality of elongated generally parallel elastomeric vibration isolating strips;

means for restraining relative movement of said tubular member relative to said shank generally in a plane defined by a racquet face, said means including an adhesive bond between each of said elastomeric strips and said shank and between each of said elastomeric strips and said tubular member; and, moisture removal means mounted on said tubular member, said moisture removal means having a plurality of moisture removal apertures extending therethrough with at least a portion in communication with said annular cavity through said tubular member apertures.

9. A racquet handle assembly as set forth in claim 8, wherein said tubular member apertures and said moisture removal apertures randomly register to provide a mixture of registered and non-registered apertures.

10. A racquet handle assembly as set forth in claim 8, wherein said tubular member apertures comprise at least 40% of the surface area of said tubular member.

11. A racquet handle assembly as set forth in claim 8, wherein said moisture removal apertures comprise at least 20% of the surface area of said moisture removal means.

12. A racquet handle assembly extending from a racquet head having a racquet face, said racquet handle assembly comprising:

a shank extending from a racquet head;

a tubular rigid one piece member positioned about said shank and cooperating with said shank to define an annular cavity, said tubular member having a plurality of apertures extending through said tubular member;

a plurality of ribs in said tubular member, each of said ribs extending longitudinally generally parallel to said shank and being directed inwardly toward said shank generally parallel to a plane of a racquet face and terminating generally adjacent a surface of said shank;

at least first and second spaced shock absorbing means disposed between said shank and said tubular member, each of said shock absorbing means being situated between adjacent ones of said plurality of ribs and in a plane generally parallel to a plane of a racquet face, each of said shock absorbing means being an elongated elastomeric vibration isolating strip which is adhesively bonded to said shank and to said tubular member to yieldingly allow relative movement between said tubular member and said shank in a plane substantially orthogonal to a plane defined by a racquet face and to restrain relative movement between said tubular member and said shank generally in a plane defined by a racquet face; and, moisture removal means mounted on said tubular member, said moisture removal means having a plurality of moisture removal apertures extending therethrough and being in communication with said annular cavity through said tubular member apertures.

13. A racquet handle assembly extending from a racquet head having a racquet face, said racquet handle assembly comprising:

a shank extending from a racquet head;

a tubular member positioned about said shank and cooperating with said shank to define an annular cavity, said tubular member having a plurality of apertures extending through said tubular member;

a plurality of ribs n said tubular member, each of said ribs extending longitudinally generally parallel to said shank and being directed inwardly toward said shank generally parallel to a plane of a racquet face and terminating generally adjacent a surface of said shank;

a plurality of ridges in said tubular member, each of said ridges extending longitudinally generally parallel to said shank and being directed inwardly toward said shank generally perpendicularly to a plane of a racquet face;

a plurality of elastomeric shock absorbing strips disposed on opposing sides of said shank between said shank and said tubular member generally in parallel planes defined by a racquet face, each of said strips being situated adjacent one of said ridges, and being joined to said shank and said solid one piece tubular member to yieldingly allow relative movement between said shank and said tubular member in a plane substantially orthogonal to a plane defined by a racquet face and to restrain relative movement between said tubular member and said shank generally in a plane defined by a racquet face; and, moisture removal means mounted on said tubular member, said moisture removal means having a plurality of moisture removal apertures extending therethrough and being in communication with said annular cavity through said tubular member apertures.

14. A racquet handle assembly as set forth in claim 13 further including a butt cap mounted about a free end of said tubular member, said butt cap having means for communicating air flow into said annular cavity.

* * * * *